US005809621A

United States Patent [19]

McCree et al.

[11] Patent Number: 5,809,621

[45] Date of Patent: Sep. 22, 1998

[54] RECLOSABLE FASTENER ASSEMBLY WITH A PLASTIC ZIPPER AND SLIDER

[75] Inventors: John O. McCree, Bay City; Richard Dawkins, Saginaw; Ken A. Toney, Midland, all of Mich.

[73] Assignee: S. C. Johnson Home Storage Inc., Racine, Wis.

[21] Appl. No.: 780,115

[22] Filed: Dec. 26, 1996

[51] Int. Cl.[6] ..... A44B 19/00; B65D 33/00

[52] U.S. Cl. ..... 24/399; 24/400; 24/587

[58] Field of Search ..... 24/399, 400, 403, 24/430, 433, 587, 588, 589, 576; 383/63

[56] References Cited

U.S. PATENT DOCUMENTS

| | | | |
|---|---|---|---|
| 2,620,535 | 12/1952 | Steiner | 24/400 |
| 3,103,049 | 9/1963 | Hawley | 24/400 |
| 3,324,523 | 6/1967 | Mulka | 24/400 |
| 4,046,408 | 9/1977 | Ausnit . | |
| 4,212,337 | 7/1980 | Kamp . | |
| 4,285,105 | 8/1981 | Kirkpatrick | 24/400 |
| 4,363,345 | 12/1982 | Scheibner . | |
| 4,561,108 | 12/1985 | Kamp . | |
| 4,747,702 | 5/1988 | Scheibner . | |
| 4,812,056 | 3/1989 | Zieke . | |
| 5,301,395 | 4/1994 | Richardson et al. | 24/399 |
| 5,356,222 | 10/1994 | Kettner et al. | 24/587 |
| 5,638,586 | 6/1997 | Malin et al. | 24/587 |

FOREIGN PATENT DOCUMENTS

| | | |
|---|---|---|
| 3256411 | 7/1960 | Japan . |

*Primary Examiner*—Victor N. Sakran

[57] ABSTRACT

A reclosable fastener assembly comprising two profile strips with interlocking hooks, with a pair of handles positioned along the length of the outer surface of the second fastener strip, the handles adapted to cooperate with the second profile, such that when the handles are squeezed together, the hooks of the second profile disengage with the hooks of the first profile to open the fastener assembly. A slider moves along the fastening strips in straddling relation, the slider including means for squeezing the handles together as the slider moves toward the open position so that the profiles disengage. The profiles reengage when the slider moves in the reverse direction. Also disclosed are the slider and the closure.

10 Claims, 2 Drawing Sheets

RECLOSABLE FASTENER ASSEMBLY WITH A PLASTIC ZIPPER AND SLIDER

BACKGROUND OF THE INVENTION

Reclosable fastener assemblies are useful for sealing thermoplastic bags. Such fastener assemblies often include a plastic zipper. Typically, the plastic zippers include a pair of interlockable fastener elements, or profiles, that form a closure. When the profiles are interlocked, the closure is closed.

The profiles of the plastic zippers can take on various configurations. For example, U.S. Pat. No. 5,140,727 describes interlocking rib and groove elements, whereas U.S. Pat. No. 5,007,143 describes a rolling action zipper profile, and U.S. Pat. No. 3,173,184 describes profiles that have alternating hook-shaped closure elements.

Sometimes, the profiles are interlocked using the fingers of the person using the bag. For example, U.S. Pat. No. 5,140,727 describes using a thumb to interlock a rib and groove profile, and U.S. Pat. No. 4,812,056 describes squeezing an external portion of the fastener to close the bag.

Sometimes, however, the profiles are interlocked using a slider which moves across the profiles. The sliders for opening or closing the reclosable fasteners are generally shaped so that the slider straddles the profiles. The sliders often include a separating element that fits between the profiles or slides above the profiles between specially designed tracks. For example, U.S. Pat. No. 3,173,184 describes a V-shaped separating element, while U.S. Pat. No. 5,067,208 describes a tapered separating element with a circular end.

The present invention represents a different mechanism for opening and closing a thermoplastic bag with a plastic zipper and slider.

SUMMARY OF THE INVENTION

In one aspect, the present invention is a reclosable fastener assembly comprising: a first fastener strip having an inner surface and an outer surface; a second fastener strip having an inner surface and an outer surface; a first profile positioned along the length of the inner surface of the first fastener strip, the first profile projecting outwardly from the inner surface, the first profile having two hooks on the distal end, the hooks facing away from each other; a second profile positioned along the length of the inner surface of the second fastener strip, the second profile projecting outwardly from the inner surface, the second profile having two hooks on the distal ends, each hook facing toward the other hook such that the hooks of the second profile can fit around the hooks of the first profile, to engage the first and second profiles; a pair of handles positioned along the length of the outer surface of the second fastener strip, the pair of handles aligned opposite the second profile, the pair of handles adapted to cooperate with the second profile, such that when the pair of handles are squeezed together, the hooks of the second profile disengage with the hooks of the first profile to open the fastener assembly, and when the pair of handles are released, the hooks of the second profile engage with the hooks of the first profile to close the fastener assembly; and a slider for moving between an open position and a closed position along the fastening strips in straddling relation, the slider having a top positioned on the top edges of the fastening strips, the slider having a first side wall and a second side wall depending from opposite sides of the top for receiving the fastening strips therebetween, the side walls extending from a leading end of the slider to a trailing end, the slider including means for squeezing the handles together as the slider moves toward the open position so that the first profile and the second profile disengage.

In a second aspect, the present invention is a slider for opening and closing a fastener. The slider comprises: a top having a left side and a right side; a first side wall extending from the left side of the top and having an inside, an outside, a leading end and a trailing end; an opposing second side wall extending from the right side of the top and having an inside, an outside, a leading end and a trailing end; a channel on the inside of the second side wall which runs the length of the second side wall from the leading end to the trailing end, the channel being substantially parallel to the top of the slider, the channel being wider at the leading end than at the trailing end.

In a third aspect, the present invention is a plastic closure. The closure comprises: a first fastener strip having an inner surface and an outer surface; a second fastener strip having an inner surface and an outer surface; a first profile positioned along the length of the inner surface of the first fastener strip, the first profile projecting inwardly from the inner surface, the first profile having two hooks on the distal end thereof, the hooks facing away from each other; a second profile positioned along the length of the inner surface of the second fastener strip, the second profile projecting inwardly from the inner surface, the second profile having two hooks on the distal end thereof, each hook facing toward the other hook such that the hooks of the second profile can fit around the hooks of the first profile, thereby interlocking the first and second profiles; and a pair of handles positioned along the length of the outer surface of the second fastener strip, the pair of handles aligned opposite the second profile, the pair of handles adapted to cooperate with the second profile, such that when the pair of handles are squeezed together, the hooks of the second profile are pulled apart so that the first and second profiles are disengaged to open the closure, and when the pair of handles are released, the hooks of the second profile engage with the hooks of the first profile to close the closure.

DESCRIPTION OF THE PREFERRED EMBODIMENTS

Figure 1:
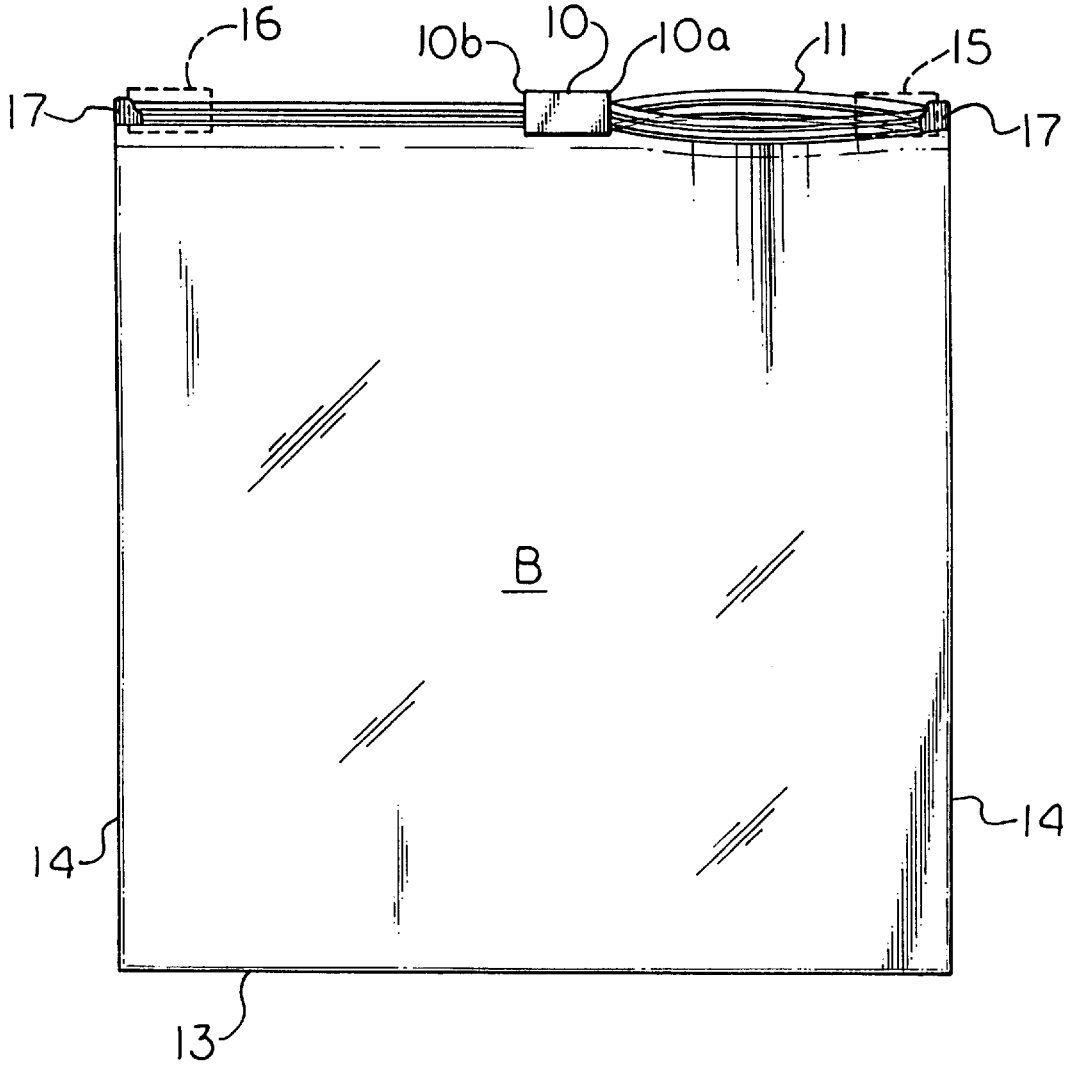
FIG. 1 is a front view of a bag having the fastener assembly of the present invention.

Referring now to FIG. 1, therein is shown a reclosable thermoplastic bag B having a profiled plastic reclosable fastener 11 and a slider 10 straddling the reclosable fastener, embodying the present invention. The slider 10 moves between an open position 16 and a closed position 15.

Bag B also has a sealed bottom 13 and two opposing sealed edges 14. Bag B may be made from any suitable thermoplastic film such as, for example, low density polyethylene, linear low density polyethylene, substantially linear copolymers of ethylene and a C3–C8 $\alpha$-olefin, polypropylene, polyvinylidene chloride, mixtures of two or more of these polymers, or mixtures of one of these polymers with another thermoplastic polymer.

Figure 2:
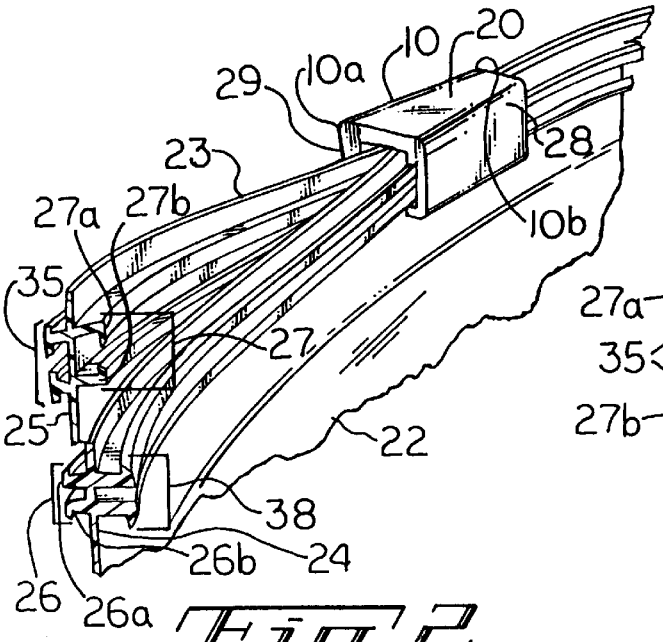
FIG. 2 is a perspective view of a closure and slider of the present invention.

Referring now to FIG. 2, the bag B comprises a pair of flexible plastic sheets 22 and 23. The sheet 22 has a first fastener strip 24 attached thereto. The first fastener strip 24 has an inner surface and an outer surface. The sheet 23 has a second fastener strip 25 attached thereto. The second fastener strip 25 has an inner surface and an outer surface. The fastener strips 24 and 25 may be extruded separately and attached to the respective sides of the bag or extruded integrally with the sides of the bag.

First fastener strip 24 includes a first profile 26 which extends along the inner surface of the first fastener strip 24. Second fastener strip 25 includes a second profile 27 which extends along the inner surface of the second fastener strip 24. When the bag is closed, the first profile 26 interlocks with the second profile 27, so that the profiles are interlocked throughout substantially their entire length, thereby forming a seal. The seal advantageously is such that under normal conditions of use, it forms a barrier to liquids.

Figure 3A:
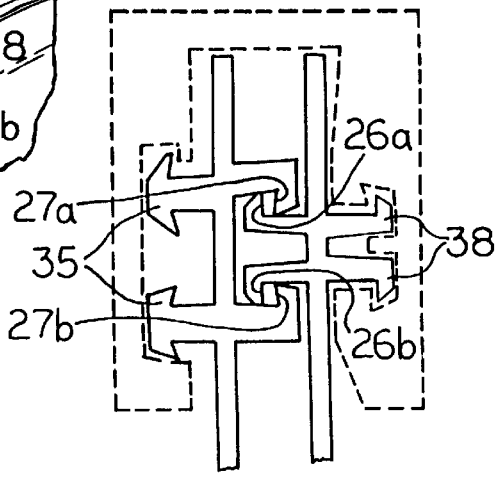
FIGS. 3A–3C are sectional views of a closure of the present invention showing how the closure cooperates with the slider of the present invention.
Figure 3C:
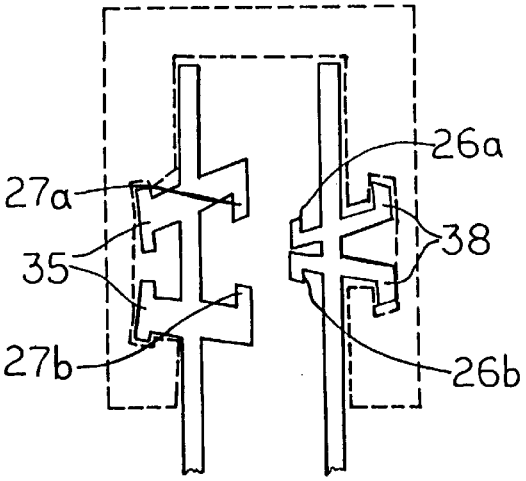
Figure 3B:
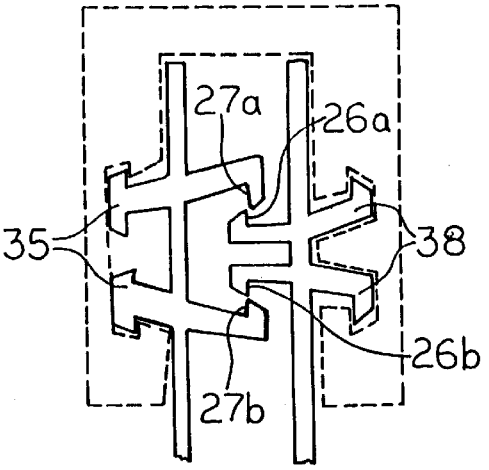

The first profile 26 is positioned along the length of the inner surface of the first fastener strip 24. As shown in FIGS. 3A–C, the first profile 26 projects outwardly from the inner surface of the first fastener strip. The first profile 26 has a distal end on the opposite end from where the first profile 26 is attached to the fastener strip 24. The first profile 26 has two hooks 26*a* and 26*b* on the distal end, which face away from each other. In a preferred embodiment, the first profile 26 includes two projections, as shown. Each projection has a hook, and each hook faces away from the other.

As shown in FIGS. 3A–C, the second profile 27 projects outwardly from the inner surface of the second fastener strip. The second profile 27 includes two projections which have distal ends on the opposite end from where the second profile 27 is attached to the second fastener strip 25. The second profile 27 has two hooks 27*a* and 27*b* on the distal end, each hook facing toward the other hook. The configuration of the hooks is such that the hooks 27*a* and 27*b* of the second profile 27 can fit around the hooks 26*a* and 26*b* of the first profile 26. In this manner, the first and second profiles are engaged, as shown in FIG. 3A.

The mechanism which allows the hooks 27*a* and 27*b* of the second profile 27 to fit around the hooks 26*a* and 26*b* of the first profile 26 is produced by a pair of handles 35 positioned along the length of the outer surface of the second fastener strip 25. The pair of handles 35 is aligned opposite the second profile 27. The pair of handles 35 is adapted to cooperate with the second profile 27, such that when the handles 35 are squeezed together, the hooks 27*a* and 27*b* of the second profile 27 are opened up in order to disengage with the hooks 26*a* and 26*b* of the first profile 26, thereby opening the fastener assembly, as shown in FIG. 3C. Likewise, when the pair of handles 35 are released, the hooks 27*a* and 27*b* of the second profile 27 close around the hooks 26*a* and 26*b* of the first profile 26, thereby closing the fastener assembly, as shown in FIG. 3A.

When the bag B is open, profiles 26 and 27 are separated from each other. The separating action is accomplished by means on slider 10 for squeezing the pair of handles 35, as described below.

Referring again to FIG. 1, the slider 10 moves between a closed position 15 and an open position 16. Thus, when the slider 10 reaches the closed position 15 at one end of the profiles, the bag is closed, and the profiles are interlocked throughout substantially their entire length. When the slider reaches the open position 16 at the opposite end of the fastener strips, the bag is open and the profiles are disengaged throughout substantially their entire length.

Referring again to FIG. 2, the straddling slider 10 comprises an inverted U-shaped member having a top 20 for moving along fastener strips 24 and 25. The slider 10 has side walls 28 and 29 depending from the top 20. Side walls 28 and 29 extend downward along the outer surface of the fastener strips 24 and 25, such that at least a portion of the profiles 26 and 27 are held between the side walls 28 and 29.

As shown in FIG. 2, side walls 28 and 29 extend from a leading end 10*a* of the slider to a trailing end 10*b* of the slider. Features of the slider cooperate with features of the profiles and the fastener strips to open and close the bag. More specifically, the features of the slider 10 which cooperate with the profiles 26 and 27 include means for squeezing the handles 35 together as the slider 10 moves toward the open position 16 so that the first profile 26 and the second profile 27 disengage, and means for releasing the handles 35 as the slider moves toward the closed position 15 so that the first profile 26 and the second profile 27 are engaged.

The means for squeezing and releasing the handles can include, for example, a groove 41 cut out of the second side wall 29. The groove 41 is adapted to receive the pair of handles therein. The groove 41 is smaller at the leading end 10*a* of the slider so that the handles are squeezed together to disengage the profiles, whereas the groove 41 is larger at the trailing end 10*b* of the slider so that the groove 41 allows the handles to be released, thereby engaging the profiles.

Referring again to FIG. 1, when the slider 10 is moved toward the closed position 15, the leading end 10*a* of the slider 10 leads and the trailing end 10*b* trails, so that the pair of handles are released, thereby engaging the profiles. When the slider 10 is moved toward the open position 16, the trailing end 10*b* of the slider leads, and the leading end 10*a* of the slider trails, so that the means for squeezing the pair of handles disengages the profiles 26 and 27.

The fastening assembly preferably includes means for maintaining the slider in straddling relation with the fastening strips. Optionally, the slider can include a knob 51 extending inward from the groove in the second side wall 29. The knob 51 is adapted to slide between the handles. The knob 51 is smaller at the leading end 10*a* of the slider and larger at the trailing end 10*b* of the slider. The knob 51 prevents the slider from falling off the fastener assembly. Furthermore, as shown in FIGS. 3A–3C, the fastener can include at least one track 38 disposed along the length of the outer surface of the first profile 26. In this embodiment, the slider 10 further comprises a channel 43 in the first sidewall 28, the channel 43 adapted to receive the track 38 therein, such that the cooperation between the track 38 and the channel 43 prevents the slider 10 from coming off the fastener assembly.

The slider 10 may be made in multiple parts and welded together or the parts may be constructed to be snapped together. The slider 10 may also be of one piece construction. The slider can be made using any desired method, such as, for example, injection molding. The slider can be molded from any suitable plastic such as, for example, nylon, polypropylene, polystyrene, acetal, toughened acetal, polyketone, polybutylene terephthalate, high density polyethylene, polycarbonate, or ABS. The slider can be clear, opaque, or colored.

The slider 10 can be attached to the bag by any desirable method. For example, the slider can be attached to the bag by snapping together a multi-part slider, as described in U.S. Pat. No. 5,007,142 or by folding a foldable slider as described in U.S. Pat. No. 5,010,627. The slider may also be attached to the bag by cutting the profiles and inserting the slider over the cut ends, as described in U.S. Pat. No. 5,431,760. The slider can also be attached to the bag by the use of a tool which produces a reciprocating movement to separate the walls of the slider so that the slider can fit over the profiles, as described in U.S. Pat. No. 4,262,395.

A bag incorporating the fastener and slider of the present invention preferably includes means for preventing the slider from sliding off the end of the bag once the slider reaches the closed position 15 or open position 16. Such means for preventing the slider from sliding off the end of the bag preferably includes end stops, such as end stops 17 shown in FIG. 1. End stops 17 perform the dual function of stops for the ends of the fastener 11 to prevent the slider 10 from going off past the end of the fastener 11 and they also hold the two profiles 26 and 27 together to prevent the bag from opening in response to stresses applied to the profiles through normal use of the bag. The end stops 17 also provide a convenient finger grip for the user when moving the slider 10. Examples of end stops include riveted end clamps as described in U.S. Pat. Nos. 5,067,208 and 5,161,286, transverse end stops made from molten material for the profiles, as described in U.S. Pat. No. 5,088,971, reciprocating anvils, as described in U.S. Pat. No. 5,131,121, tubular end stops, as described in U.S. Pat. No. 5,405,478, a window structure combined with sealed zipper ends, as described in U.S. Pat. No. 5,442,837, or plastic end clips fused to the zipper as described in U.S. Pat. No. 5,448,807.

The fastening assembly of the present invention optionally includes means for retaining the slider in the closed position so that a bag incorporating the zipper and slider of the present invention does not inadvertently open. For example, the means for retaining the slider in closed position can comprise "speed bumps" as described in U.S. Pat. No. 5,189,764, or a detent lock structure as described in U.S. Pat. No. 5,301,394.

The fastener strips of the present invention, which include the profiles and attachment flanges for attaching the fastener strips to the sides of the bag, can be made by any conventional technique, including, for example, cast integral extrusion or water bath extrusion. The fastener strips can be extruded separately or at the same time.

The side seals and bottom seal of the bag can be formed by folding the film, by heat sealing, or by any other desired method.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A reclosable fastener assembly comprising:

a) a first fastener strip having an inner surface and an outer surface;

b) a second fastener strip having an inner surface and an outer surface;

c) a first profile positioned along the length of the inner surface of the first fastener strip, the first profile projecting outwardly from the inner surface, the first profile having two hooks on the distal end, the hooks facing away from each other;

d) a second profile positioned along the length of the inner surface of the second fastener strip, the second profile projecting outwardly from the inner surface, the second profile having two hooks on the distal ends, each hook facing toward the other hook such that the hooks of the second profile can fit around the hooks of the first profile, to engage the first and second profiles;

e) a pair of handles positioned along the length of the outer surface of the second fastener strip, the pair of handles aligned opposite the second profile, the pair of handles adapted to cooperate with the second profile, such that when the pair of handles are squeezed together, the hooks of the second profile disengage with the hooks of the first profile to open the fastener assembly, and when the pair of handles are released, the hooks of the second profile engage with the hooks of the first profile to close the fastener assembly; and f) a slider for moving between an open position and a closed position along the fastening strips in straddling relation, the slider having a top positioned on the top edges of the fastening strips, the slider having a first side wall and a second side wall depending from opposite sides of the top for receiving the fastening strips therebetween, the side walls extending from a leading end of the slider to a trailing end, the slider including means for squeezing the handles together as the slider moves toward the open position so that the first profile and the second profile disengage.

2. The fastener assembly of claim 1 wherein the means included in the slider for squeezing the pair of handles includes a groove cut out of the second side wall, the groove being adapted to receive the pair of handles therein, the groove being smaller at the leading end of the slider so that the handles are squeezed together to disengage the profiles, the groove being larger at the trailing end of the slider so that the handles are released to engage the profiles.

3. The fastener assembly of claim 2, further comprising:

g) at least one track disposed along the length of the outer surface of the first profile;

wherein the slider further comprises a channel in the first sidewall, the channel adapted to receive the track therein, such that the cooperation between the track and the channel of the first sidewall prevents the slider from coming off the fastener assembly.

4. The fastener assembly of claim 3, wherein the first profile includes two closure elements, each closure element having a hook on the distal end, the hooks of the first profile facing away from each other; and the second profile includes two closure elements, each closure element having a hook on the distal end, the hooks of the second profile facing toward each other.

5. The fastener assembly of claim 4 wherein the slider further comprises a knob extending inward from the groove in the second side wall, the knob being adapted to slide between the handles, the knob being smaller at the leading end of the slider and larger at the trailing end of the slider so that the knob prevents the slider from falling off the fastener assembly.

6. The fastener assembly of claim 5, wherein at least one of the profiles is colored.

7. A slider for opening and closing a fastener, comprising:

a) a top having a left side and a right side;

b) a first side wall extending from the left side of the top and having an inside, an outside, a leading end and a trailing end;

c) an opposing second side wall extending from the right side of the top and having an inside, an outside, a leading end and a trailing end;

d) a channel on the inside of the second side wall which runs the length of the second side wall from the leading end to the trailing end, the channel being substantially parallel to the top of the slider, the channel being wider at the leading end than at the trailing end.

8. The slider of claim 7, further comprising a groove in the first side wall extending along the length of the first side wall from the leading end to the trailing end, the groove being larger at the trailing end than at the leading end.

9. The slider of claim 8, further comprising:

e) a knob extending inwardly from the groove in the second side wall which runs the length of the second side wall from the leading end to the trailing end, the knob being substantially parallel to the top of the slider, the knob being wider at the leading end than at the trailing end.

10. A closure comprising:

a) a first fastener strip having an inner surface and an outer surface;

b) a second fastener strip having an inner surface and an outer surface;

c) a first profile positioned along the length of the inner surface of the first fastener strip, the first profile projecting inwardly from the inner surface, the first profile having two hoods on the distal end thereof, the hooks facing away from each other;

d) a second profile positioned along the length of the inner surface of the second fastener strip, the second profile projecting inwardly from the inner surface, the second profile having two hooks on the distal end thereof, each hook facing toward the other hook such that the hooks of the second profile can fit around the hooks of the first profile, thereby interlocking the first and second profiles; and e) a pair of handles positioned along the length of the outer surface of the second fastener strip, the pair of handles aligned opposite the second profile, the pair of handles adapted to cooperate with the second profile, such that when the pair of handles are squeezed together, the hooks of the second profile are pulled apart so that the first and second profiles are disengaged to open the closure, and when the pair of handles are released, the hooks of the second profile engage with the hooks of the first profile to close the closure; and f) at least one track disposed along the length of the outer surface of the first profile.

* * * * *